US008633859B2

(12) United States Patent
Chou

(10) Patent No.: US 8,633,859 B2
(45) Date of Patent: Jan. 21, 2014

(54) ANTENNA MODULE

(75) Inventor: Ming-Yu Chou, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 378 days.

(21) Appl. No.: 13/216,740

(22) Filed: Aug. 24, 2011

(65) Prior Publication Data

US 2012/0313836 A1 Dec. 13, 2012

(30) Foreign Application Priority Data

Jun. 13, 2011 (TW) ..... 100120555 A

(51) Int. Cl.
*H01Q 1/38* (2006.01)

(52) U.S. Cl.
USPC ..... 343/700 MS; 343/702

(58) Field of Classification Search
USPC ..... 343/700 MS, 702, 893
See application file for complete search history.

(56) References Cited

U.S. PATENT DOCUMENTS 8,009,114 B2 * 8/2011 Hauhe et al. ..... 343/754
2008/0007460 A1 * 1/2008 Ke et al. ..... 343/700 MS

* cited by examiner

*Primary Examiner* — Tan Ho
(74) *Attorney, Agent, or Firm* — Altis Law Group, Inc.

(57) ABSTRACT

An antenna module includes a support and an antenna. The support includes an upper surface and has a through hole defined in a middle of the upper surface. The antenna includes a feed unit, a first radiator unit, and a second radiator unit. One end of the feed unit is positioned on the upper surface. The other end of the feed unit passes through the through hole, and extends and attaches to a surface opposite to the upper surface. The first radiator unit and the second radiator unit are both connected to the end of the feed unit positioned on the upper surface, and both extend away from the feed unit.

13 Claims, 3 Drawing Sheets

ANTENNA MODULE

BACKGROUND

1. Technical Field

The present disclosure relates to antenna modules, and particularly to an antenna module having improved radiating performance.

2. Description of Related Art

Monopole antennas are widely used in portable electronic devices, such as mobile phones, personal digital assistants, and laptop computers. To ensure a good radiating performance of a monopole antenna, an area in the electronic device around the antenna should be kept clear. However, the need for clearance around the antenna is counter to the need for increasing density of the many electronic components, such as high definition multimedia interface (HDMI) connectors, universal serial bus (USB) connectors, and speakers in the portable electronic device to achieve desired miniaturization with increased functionality.

Therefore, there is room for improvement within the art.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment.

DETAILED DESCRIPTION

Figure 1:
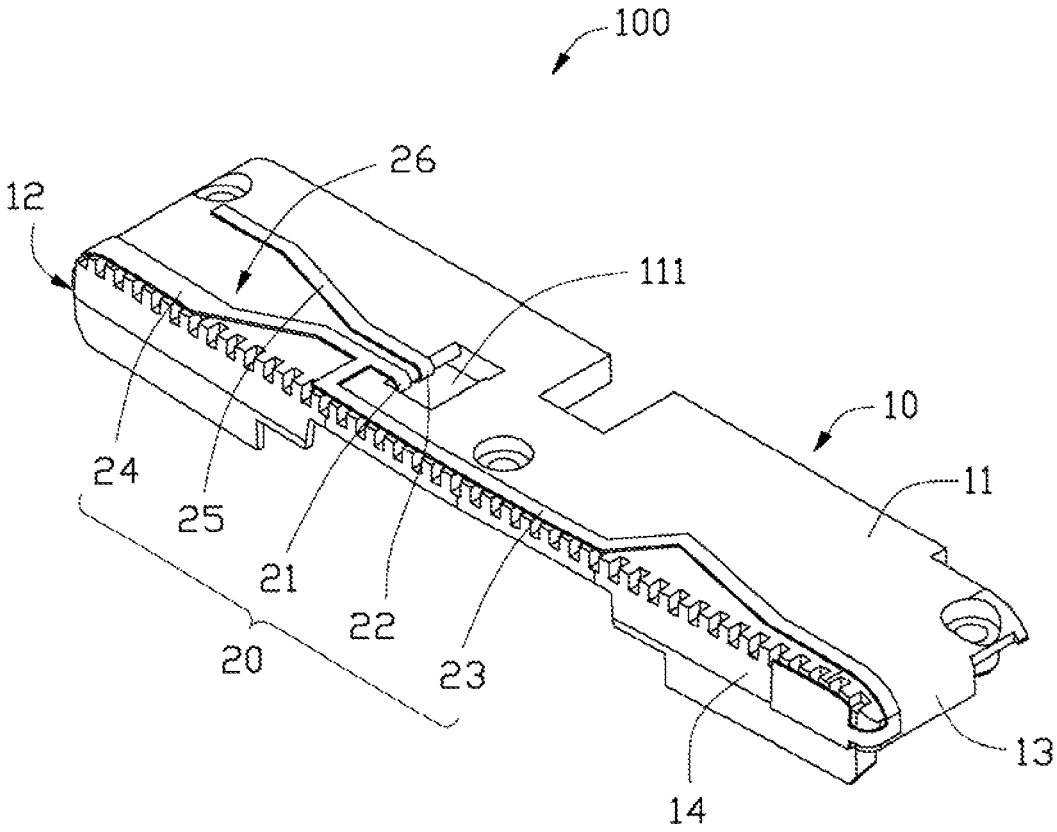
FIG. 1 is a schematic view of an antenna module, according to an exemplary embodiment.
Figure 2:
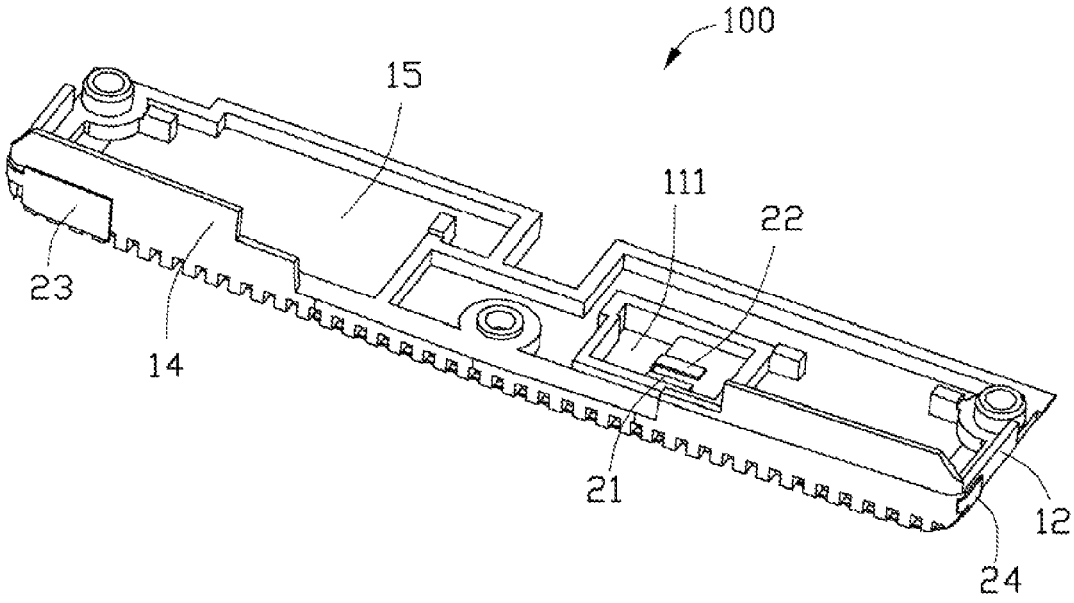
FIG. 2 is similar to FIG. 1, but viewed from another angle.

FIG. 1 and FIG. 2 show an antenna module 100, according to an exemplary embodiment. The antenna module 100 is installed in a portable electronic device (not shown) to receive and/or send wireless signals. The portable electronic device may be a mobile phone, a personal digital assistant, or a laptop computer, for example. The antenna module 100 includes a support 10, and an antenna 20.

The support 10 can be a portion of a housing of the portable electronic device. The support 10 includes an upper surface 11, a first sidewall 12, a second sidewall 13 opposite to the first sidewall 12, and a third sidewall 14 connecting the first sidewall 12 to the second sidewall 13. The first sidewall 12, the second sidewall 13, and the third sidewall 14 are approximately perpendicular to the upper surface 11, and cooperatively form a receiving space 15. The receiving space 15 can receive electronic components, such as a high definition multimedia interface (HDMI) connector, a universal serial bus (USB) connector, and/or a speaker, for example. The support 10 has a through hole 111 defined in a middle position of the upper surface 11.

The antenna 20 is a monopole antenna, and consists of conductive sheets. The conductive sheets can consist of metal sheets, flexible printed circuits, or other materials. The antenna 20 includes a feed unit 21, a ground unit 22, a first radiator unit 23, a second radiator unit 24, and a resonance unit 25.

The feed unit 21 is substantially hook-shaped. An end of the feed unit 21 is positioned on the upper surface 11. The other end of the feed unit 21 passes through the through hole 111, and extends to the receiving space 15, thereby attaching to a bottom wall of the receiving space 15, i.e. a surface opposite to the upper surface 11. The feed unit 21 is electronically connected to a feed point of a circuit board of the portable electronic device (not shown).

The ground unit 22 is substantially hook-shaped. An end of the ground unit 22 is positioned on the upper surface 11. The other end of the ground unit 22 passes through the gap 111, and extends to the receiving space 15, thereby attaching to the bottom wall of the receiving space 15. The ground unit 22 is parallel to the feed unit 21. The ground unit 22 is electronically connected to a ground point of a circuit board of the portable electronic device (not shown).

The first radiator unit 23 is a curved sheet. The first radiator 23 is connected to an end of the feed unit 21, and extends away from the feed unit 21. The first radiator 23 is positioned in a side of the top surface 11, the second sidewall 13, and the third sidewall 14. The first radiator unit 23 can generate low frequency signals. By adjusting a width of an end of the first radiator unit 23 positioned on the third sidewall 14, an improved communication performance of the first radiator unit 23 can be efficiently achieved.

The second radiator unit 24 is a curved sheet. The second radiator unit 24 is connected to both the feed unit 21 and the first radiator unit 22, and extends away from the feed unit 21 and the first radiator unit 22. The second radiator unit 24 is positioned on the top surface 11 and the first sidewall 12. The second radiator unit 24 is shorter than the first radiator unit 23. The second radiator unit 24 can generate high frequency signals.

The resonance unit 25 is a planar sheet. The resonance unit 25 is positioned on the top surface 11, and can resonate with the first radiator unit 23 and the second radiator unit 24. The resonance unit 25 and the second radiator unit 24 are set at a same side of the first radiator unit 23. An end of the resonance unit 25 is connected to the ground unit 22, and parallel to an end of the second radiator unit 24. The other end of the resonance unit 25 gradually extends away from the ground unit 22 and the second radiator unit 24, thereby forming a slot 26. By varying the size of the slot 26, the electronic length of the antenna module 100 can be tuned to a particular desired frequency band performance. The resonance unit 25 is shorter than the second radiator unit 24.

When the antenna module 100 is installed, the ground unit 22 can be attached to a circuit board (not shown) of the portable electronic device to be grounded, and the feed unit 21 is connected to the circuit board to receive feed signals. Feed signals input from the feed unit 21 can be transmitted to the first radiator unit 23 and the second radiator unit 24 to form two current paths of different lengths. Thus, the first radiator unit 23 and the second radiator unit 24 respectively generate low frequency signals and high frequency signals, and serve as antenna members for receiving and sending wireless signals at different frequencies. Simultaneously, the resonance unit 25 is driven to resonate due to current through the first radiator unit 23 and the second radiator unit 24, and generates resonance signals accordingly. Thus, the resonance unit 25 is also enabled to serve as an antenna member for receiving and sending wireless signals of predetermined frequencies. Accordingly, the antenna module 100 can be used to receive and send wireless signals at many different frequencies.

Figure 3:
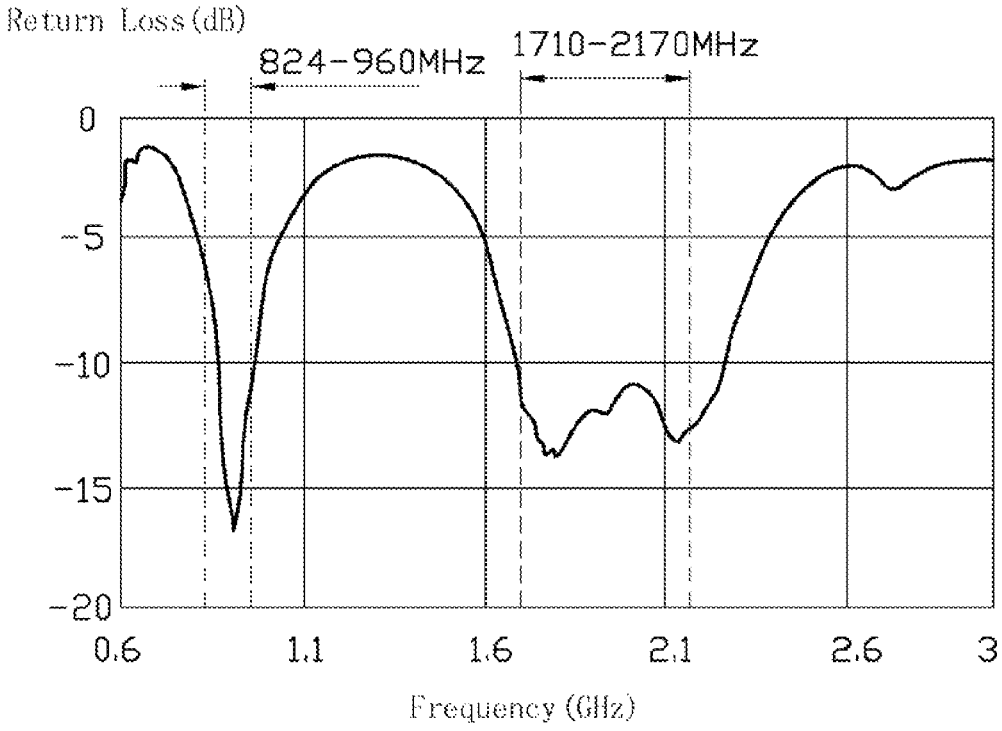
FIG. 3 is a diagram showing a return loss measurement of the antenna module shown in FIG. 1.

FIG. 3 is a measurement diagram of return loss (RL) of the antenna module 100. When the antenna module 100 receives/sends wireless signals at frequencies of about 824 MHz, 960 MHz, 1710 MHz, and 2170 MHz, the RL of the antenna module 100 is less than −6 dB, and satisfies communication standards. Accordingly, the portable electronic device employing the antenna module 100 can be used in a plurality of (more than two) common wireless communication systems, such as GSM850, EGSM900, DCS1800, PCS1900, WCDMA-I, WCDMA-II, WCDMA-IV, WCDMA-V, and WCDMA-VIII, with acceptable communication quality.

Also referring to the table 1, as shown in experiments, when the antenna module 100 receives/sends wireless signals of frequencies of GSM850, EGSM900, DCS1800, PCS1900, WCDMA-I, WCDMA-II, WCDMA-IV, WCDMA-V, and WCDMA-VIII, a transmitting efficiency (Tx) and a receiving efficiency (Rx) of the antenna module 100 are both acceptable.

TABLE 1

| Frequency (MHz) | Tx (dB) | Rx (dB) |
|---|---|---|
| GSM850 | −3.54 | −3.61 |
| EDGE900 | −3.69 | −3.71 |
| DCS1800 | −2.58 | −2.96 |
| PCS1900 | −3.20 | −2.91 |
| WCDMA-I | −3.18 | −3.05 |
| WCDMA-II | −3.20 | −2.91 |
| WCDMA-IV | −2.58 | −2.96 |
| WCDMA-V | −3.54 | −3.61 |
| WCDMA-VIII | −3.69 | −3.71 |

Compared with a conventional antenna, since the feed unit 21 and the ground unit 22 are both positioned in a middle position of the support 10, the first radiator unit 23, the second radiator unit 24, and the resonance unit 25 all extend away from the feed unit 21 and the ground unit 22. Thus, the first radiator unit 23, the second radiator unit 24, and the resonance unit 25 are also separated from the electronic components received in the receiving space 15. In this way, the antenna module 100 will be less likely to be affected by the electronic components, and has a better radiating efficiency. Furthermore, the resonance unit 25 can resonate at tuned frequencies, thereby increasing the number of frequencies used by the antenna module 100.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna module, comprising:

a support including an upper surface and having a through hole defined on a middle position of the upper surface; and an antenna including a feed unit, a first radiator unit, and a second radiator unit; wherein one end of the feed unit is positioned in the upper surface, the other end of the feed unit passes through the through hole, and extends and attaches to a surface opposite to the upper surface; the first radiator unit and the second radiator unit are both connected to the end of the feed unit positioned in the upper surface, and both extend away from the feed unit.

2. The antenna module as claimed in claim 1, wherein the first radiator unit and the second radiator unit generate low frequency signals and high frequency signals, respectively.

3. The antenna module as claimed in claim 1, wherein the first radiator unit is longer than the second radiator unit.

4. The antenna module as claimed in claim 1, wherein the antenna is a monopole antenna.

5. The antenna module as claimed in claim 1, wherein the support further includes a first sidewall, a second sidewall opposite to the second sidewall, and a third sidewall connected both the first sidewall and the second sidewall, the first sidewall, the second sidewall, and the third sidewall are approximately perpendicular to the upper surface, and cooperatively form a receiving space for receiving electronic components.

6. The antenna module as claimed in claim 5, wherein the first radiator unit is positioned on the upper surface, the second sidewall, and the third sidewall.

7. The antenna module as claimed in claim 6, wherein a communication performance of the first radiator unit can be adjusted by changing a width of an end of the first radiator unit.

8. The antenna module as claimed in claim 5, wherein the second radiator unit is positioned on the upper surface and the first sidewall.

9. The antenna module as claimed in claim 1, further including a ground unit and a resonance unit, one end of the feed unit is positioned in the upper surface, the other end of the feed unit passes through the through hole, and extends and attaches to the surface opposite to the upper surface, an end of the resonance unit is connected to the ground unit, the other end of the resonance unit extends away from the ground unit.

10. The antenna module as claimed in claim 9, wherein the resonance unit generates corresponding resonance signals.

11. The antenna module as claimed in claim 9, wherein the second radiator unit is longer than the resonance unit.

12. The antenna module as claimed in claim 9, wherein the resonance unit is positioned on the upper surface, the resonance unit and the second radiator unit are set at a same side of the first radiator unit, the end of the resonance unit connected to the ground unit is parallel to an end of the second radiator, and the other end of the resonance unit extends away from the second unit, thereby forming a slot.

13. The antenna module as claimed in claim 12, wherein the electronic length of the antenna module can be tuned to a particular desired frequency band performance by varying the size of the slot.

* * * * *